United States Patent [19]

Matsuno et al.

[11] Patent Number: 4,642,512

[45] Date of Patent: Feb. 10, 1987

[54] STAIN RESISTANT FLUORESCENT LAMP

[75] Inventors: Hiromitsu Matsuno, Hachioji; Seiichi Murayama; Tetsuo Ono, both of Kokubunji, all of Japan

[73] Assignee: Hitachi, Ltd., Tokyo, Japan

[21] Appl. No.: 667,135

[22] Filed: Nov. 1, 1984

[30] Foreign Application Priority Data

Nov. 2, 1983 [JP] Japan ..... 58-204833

[51] Int. Cl.[4] ..... H01J 61/12; H01J 61/34; H01J 61/52

[52] U.S. Cl. ..... 313/25; 313/493; 313/634

[58] Field of Search ..... 313/489, 493, 634, 635, 313/25

[56] References Cited

U.S. PATENT DOCUMENTS

| | | | |
|---|---|---|---|
| 3,541,377 | 11/1970 | Nagy | 313/489 |
| 4,199,708 | 4/1980 | Lauwerijssen et al. | 313/493 |
| 4,524,299 | 6/1985 | Preston, III | 313/489 X |

OTHER PUBLICATIONS

Hanada, "Color Television Studio Lighting", *Illuminating Engineering*, Feb., 1970, pp. 105–110.

*Primary Examiner*—David K. Moore
*Assistant Examiner*—K. Wieder
*Attorney, Agent, or Firm*—Antonelli, Terry & Wands

[57] ABSTRACT

A low-pressure mercury vapor discharge lamp comprising a glass tube in which a metal oxide or phosphate layer and then a phosphor layer are formed on its inner surface, in which during operation of the lamp, the lowest temperature of the wall of the glass tube along its discharge path is kept at 80° C. or above.

8 Claims, 3 Drawing Figures

STAIN RESISTANT FLUORESCENT LAMP

BACKGROUND OF THE INVENTION

This invention relates to an improvement of a low-pressure mercury vapor discharge lamp, and particularly to an improvement in the stain prevention of the wall of the lamp and in the lumen maintenance of the lamp.

A fluorescent lamp with a metal oxide layer formed between its glass wall and phosphor coating layer to improve the lumen maintenance, was disclosed, for example, in U.S. Pat. No. 3,541,377.

The input wattage to the fluorescent lamp, divided by $\pi Dl$ where l (cm) is the arc length of the lamp, and D (cm) is the average inner diameter of the lamp, is called the wall load. In the tubular, circular, U-shaped and double U-shaped fluorescent lamps of 0.08 W $cm^{-2}$ or above in its wall load which are now practically used, the lumen maintenance was surely improved by providing a metal oxide or phosphate layer between the glass wall and phosphor coating layer. However, according to the experiment by the inventors of this invention, when the fluorescent lamp with a metal oxide layer or phosphate layer provided between the glass wall and phosphor layer was operated at a higher wall load, part of the glass wall was colored yellow, or the so-called stain appeared, deteriorating its appearance.

SUMMARY OF THE INVENTION

Accordingly, it is an object of this invention to provide a low-pressure mercury vapor discharge lamp in which a metal oxide or phosphate layer is formed between the glass wall and the phosphor layer, and in which no stain appears, thus its appearance being excellent.

Thus, according to this invention, there is provided a low-pressure mercury vapor discharge lamp produced by forming a metal oxide layer or phosphate layer and then a phosphor layer on the inner wall of the glass tube, which is characterized in that upon operation of the lamp, the lowest-temperature portion of the wall along the discharge path of the glass tube is kept at 80° C. or above.

According to the feature of this invention, no stain appears on the glass-tube wall and hence it is possible to provide a low-pressure mercury vapor discharge lamp with excellent appearance.

DESCRIPTION OF THE PREFERRED EMBODIMENT

First, the principle of this invention will be described. The present inventors examined in detail the relation of the stain rate with the wall load and the wall temperature in the fluorescent lamp in which a metal oxide or phosphate layer and then a phosphor layer are formed on the inner wall of the glass tube. The wall temperature is the temperature of the outer side of the tube wall, measured in a room which was kept at 25° C. in still air. The stain rate was evaluated by a visual test; that is, it was "3" for (1) very bad, "2" for (2) bad, "1" for (3) not good and "0" for (4) good.

Figure 1:
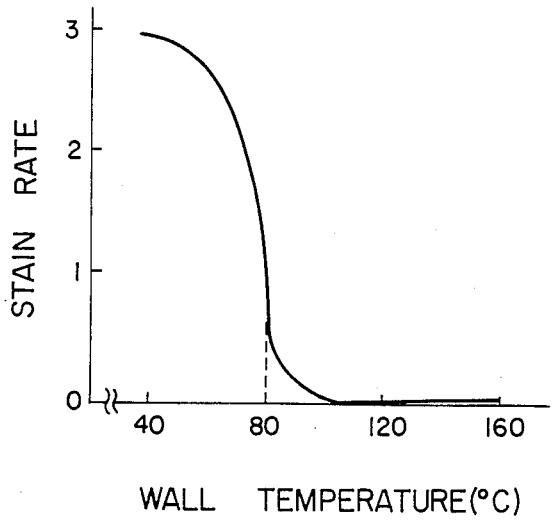
FIG. 1 is a graph of the stain rate vs. wall temperature characteristic showing the effect of this invention.

The results of this examination are as follows. First, the stain appeared when the wall load was 0.08 W $cm^{-2}$ or above, and particularly much stain occurred at 0.15 W $cm^{-2}$ or above. Secondarily, the stain appeared at the lowest temperature portion of the wall between the electrodes and along the discharge path of the glass tube. Thirdly, the relation between the stain rate and the temperature of the lowest-temperature portion of the wall between the electrodes along the discharge path of the glass tube was obtained as shown in FIG. 1. The stain rate as shown is not dependent on the wall load and rapidly decreases when the lowest-temperature portion along the discharge path is at 80° C. or above (that is, the stain rate is visually evaluated to be "1" or below under which no problem is caused in the practical use).

In addition, the analysis of the stain revealed that the stain appeared as a result of the coloring of the metal oxide or phosphate layer, not of the coloring of the glass tube and phosphor layer and that mercury was present at the stain.

Although the reason why almost no stain appeared at 80° C. or above is not always definite, the following reason can be considered from the results of the examination. The metal oxide or phosphate layer is formed by coating the particles of several tens of mμm in size, dispersed in water or the like, or by coating organometal particles and then oxidizing the coating. In either case, the layer is formed of very fine particles. The surface of each of the fine particles is generally attached with $H_2O$ molecules or OH-radicals. When mercury is adhered to and ultraviolet ray is irradiated onto the surface of each particle, the mercury and $H_2O$ or OH radical are reacted with each other to form HgO which is yellow, and thus it is observed as the stain. Occurrence of much stain at a large wall load will probably be due to the fact that the amount of radiation of ultraviolet ray, HgI 185 nm rapidly increases with the increase of the wall load. On the other hand, when the wall temperature is 80° C. or above, the evaporation rate of mercury greatly increases so that mercury cannot be present on the layer, and thus HgO and hence stain will not be caused.

As described, if the temperature of the coldest spot between the electrodes is increased to 80° C. or above, mercury cannot be present on the layer and thus stain can be prevented from occuring.

Figure 2:
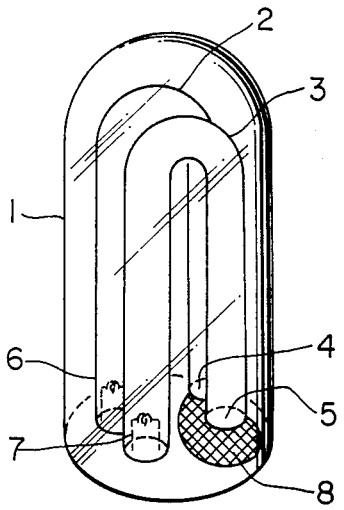
FIGS. 2 and 3 show the fundamental structure of an embodiment of a low-pressure mercury vapor discharge lamp of this invention.

An embodiment of the invention will be described with reference to FIGS. 2 and 3. FIG. 2 shows the structure of a low-pressure mercury vapor discharge lamp according to this invention. Within an airtight tubular outer bulb 1 are included substantially U-shaped interior glass tubes 2 and 3 having open ends 4 and 5 at one ends and electrodes 6 and 7 at the other ends, and a mixture of mercury and argon gas of 5 Torr. The discharge between the interior glass tubes 2 and 3 is connected at a plasma 8. The conventional fluorescent lamps produced so far have features of small size, high output and high efficiency, as, for example, disclosed in U.S. Pat. No. 4,199,708.

According to this invention, in addition to the conventional structure $Al_2O_3$ particles of 20 mμm in average diameter is coated on the inner sides of the interior glass tubes 2 and 3 in about 2-μm thickness and then the mixture of phosphors $Y_2O_3$: Eu and $LaPO_4$: Ce, Tb is coated on the $Al_2O_3$ coating. The interior glass tubes 2 and 3 each have an inner diameter of 1.2 cm and a discharge path length of 13 cm. The outer bulb 1 is a cylinder having an inner diameter of 7 cm and a length of 10 cm.

When the fluorescent lamp of this invention was operated at an input power of 16 watts (corresponding to the wall load of 0.16 W $cm^{-2}$), the lowest wall temperature along the discharge path of the inner glass tubes 2 and 3 was 150° C., which is within the lowest temperature range of this invention. As a result, no stain appeared and thus the appearance of the lamp was kept excellent.

Figure 3:
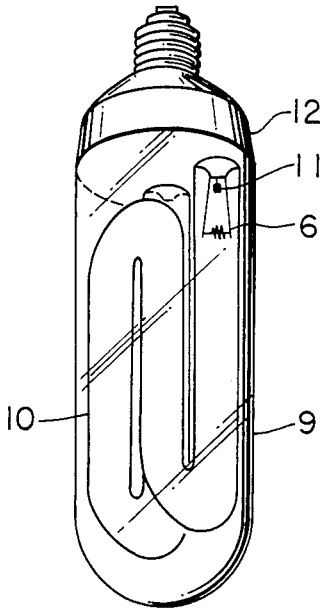

FIG. 3 shows another embodiment of this invention. This lamp is formed of a saddle-shaped fluorescent lamp 10 (which may also be U-shaped), an outer bulb 9 provided for increasing the temperature of the tube wall of the lamp 10, an electrode 6 (the other electrode is not shown), a mercury alloy 11 for keeping the mercury vapor within the saddle-shaped fluorescent lamp 10 at an optimum pressure, and a ballast case 12 in which a ballast is housed. The saddle-shaped fluorescent lamp 10 has an inner diameter of 0.9 cm and a discharge length of 40 cm. On the inner wall of the lamp 10 is coated $SiO_2$ articles of 50 mμm in diameter in a thickness of about 3 μm, and then the same phosphor material as used in the embodiment of FIG. 2. The outer bulb 9 is a transparent plastic shell of 7-cm outer diameter. When this lamp was operated at a power input of 12 watts (corresponding to wall load of 0.11 W $cm^{-2}$), the lowest temperature of the wall along the discharge path of the saddle-shaped fluorescent lamp 10 was 85° C. which is within the temperature range of the invention. As a result, no stain appeared and the appearance of the lamp was excellent.

In order that the lowest temperature of the wall along the discharge path of the glass tube can be maintained at 80° C. or above, it is also effective to consider the wall load, the shape and inner volume of the outer bulb, the shape of the inner tube and the position of the inner tube in the outer bulb except the structures of the above-mentioned two embodiments.

According to this invention it is possible to produce a low-pressure mercury vapor discharge lamp that causes no stain even at a high wall load and thus keeps its appearance excellent.

We claim:

1. A fluorescent lamp comprising glass tube means for forming a discharge path between a pair of electrodes and provided with a phosphor layer on the inner wall thereof, a layer consisting of one of a metal oxide and a phosphate being provided between said inner wall of said glass tube means and said phosphor layer, and means for keeping to 80° C. or above the lowest temperature on the wall of said glass tube means along said discharge path to prevent stain from occuring.

2. A fluorescent lamp according to claim 1, wherein said glass tube means is enclosed in an airtight outer bulb and has an opening to a space of said airtight outer bulb.

3. A fluorescent lamp according to claim 2, wherein said glass tube means is formed of two inner bent glass tubes each having said opening at one end and an electrode at the other end.

4. A fluorescent lamp according to claim 1, wherein said glass tube means is enclosed in an outer bulb and is formed of an inner bent glass tube.

5. A fluorescent lamp comprising glass tube means for forming a discharge path between a pair of electrodes disposed within an airtight outer bulb; a first layer provided on the inner wall of said glass tube means; and a phosphor layer provided on said first layer; wherein said first layer consists of one of a metal oxide and a phosphate; and wherein the wall load of the lamp, the shape and inner volume of said outer bulb, the shape of said glass tube means and the position of said glass tube means in the outer bulb are such that, during operation of the lamp, the lowest temperature of the wall of said glass tube means along its discharge path is maintained at 80° C. or above to prevent stain from occuring.

6. A fluorescent lamp according to claim 5, wherein said glass tube means is formed of two inner bent glass tubes each having said opening at one end and an electrode at the other end.

7. A fluorescent lamp according to claim 5, wherein said glass tube means is formed of a single inner bent glass tube.

8. A fluorescent lamp according to claim 5, wherein said glass tube means has an opening which communicates with the space of said airtight outer bulb.

* * * * *